US005093864A

United States Patent [19]

Sekiguchi et al.

[11] Patent Number: 5,093,864

[45] Date of Patent: Mar. 3, 1992

[54] SILENCER

[75] Inventors: Yasuyuki Sekiguchi, Ibaraki; Keiji Nakanishi, Takatsuki, both of Japan

[73] Assignee: Kabushiki Kaisha Toshiba, Kawasaki, Japan

[21] Appl. No.: 485,559

[22] Filed: Feb. 27, 1990

[30] Foreign Application Priority Data

Feb. 28, 1989 [JP] Japan ..... 1-47721

[51] Int. Cl.[5] ..... G10K 11/16

[52] U.S. Cl. ..... 381/71

[58] Field of Search ..... 381/71; 318/785

[56] References Cited

U.S. PATENT DOCUMENTS 4,366,426 12/1982 Turlej ..... 318/785
4,605,888 8/1986 Kim ..... 318/785
4,783,817 11/1988 Hamada et al. ..... 381/71

OTHER PUBLICATIONS

Bleazey, J. C. "Electronic Sound Absorber", Apr. 1962.

*Primary Examiner*—Forester W. Isen

*Assistant Examiner*—Sylvia Chen

*Attorney, Agent, or Firm*—Cushman, Darby & Cushman

[57] ABSTRACT

A silencer for deadening noise produced with drive of a motor-compressor disposed in a machine compartment of a refrigerator includes a data storage for previously storing sound wave data for every starting condition of the compressor, the sound wave data corresponding to sound waves produced by the compressor during a starting period thereof, the sound wave data being sound wave signals suitable for reducing sound from the compressor by the effect of sound wave interference, a control for determining the starting condition at the starting of the compressor, the control further reading out, from the data storage, the sound wave data corresponding to the determined starting condition, during the starting of the compressor, and a sound producer driven in response to the sound wave data read out from the data storage in the form of an electrical signal, thereby producing sound waves, the sound producer being disposed so that sound is directed to the interior of the machine compartment.

7 Claims, 4 Drawing Sheets

SILENCER

BACKGROUND OF THE INVENTION

The present invention relates to a silencer for deadening noise produced from a refrigerant compressor of a refrigeration system by the effect of sound wave interference.

Almost every home is generally furnished with refrigeration system such as a household refrigerator, which is in continuous operation throughout seasons. Such a household refrigerator has. In the refrigerator, one critical noise source is a machine compartment enclosing a compressor and piping system connected to the compressor. More specifically, from the machine compartment is emanating relatively loud noise, for example, noise produced with drive of a compressor motor, noise produced with flowing of the compressed gas, and mechanical noise produced by movable members of a compression mechanism. Further, the piping system connected to the compressor produces noise due to vibration thereof. The noise emanating from the machine compartment thus accounts for a large part of noise of the refrigerator. Accordingly, control of noise from the machine compartment contributes to noise reduction in the refrigerator.

Conventionally, compressors of the low noise type such as a rotary compressor have been employed for the purpose of reducing noise emanating from the machine compartment. Further, the construction of vibration-proofing of the compressor has been improved and the configuration of the piping has been improved, thereby providing damping of vibration in a vibration transmission path. Further, noise absorptive and insulative members have been disposed around the compressor and piping system, thereby improving an amount of noise absorbed in the machine compartment a noise transmission loss.

However, a plurality of ventilating openings are formed in one or more of walls defining the machine compartment for ventilating the machine compartment, and the noise produced in the machine compartment is caused to leak outward through the ventilating openings. As the result of provision of the ventilating openings, the above-mentioned conventional noise-reduction methods each have a definite limit and provide the noise reduction of 2 dB (A) at the most.

On the other hand, with advancement of applied electronics technique including sound data processing circuitry and acoustic control technique, application of a noise control wherein noise is deadened by the effect of sound wave interference has recently been taken into consideration. More specifically, in the above-mentioned noise control, sound generated by a noise source is received by a sound receiver such as a microphone disposed in a specific position and the sound receiver generates an electrical signal in accordance with the received sound. The electrical signal is then converted to a control signal by signal converting means. The control signal is supplied to a speaker so that an artificial sound of opposite phase or 180° out of phase with the noise received by the microphone and having the frequencies same as those and the amplitude same as that of the received sound is produced by the speaker, so that the artificial sound interferes with the received sound, thereby deadening the sound.

However, when such a noise control is applied to the refrigeration system such as a household refrigerator, the following circumstances peculiar to the refrigeration system needs to be taken into account. That is, energization and deenergization of the compressor are alternately reiterated with increase and decrease of the storage compartment temperature. At the starting of the compressor, particularly, the revolution of the compressor motor is rapidly increased from 0 to, for example, 3,600 rpm. in several hundredths of seconds. With such a rapid increase in revolution, the noise level is instantaneously increased a large extent. Thereafter, the noise level is decreased as the revolution is stabilized, as shown in FIG. 7. Since the sound pressure of noise is low and stabilized in the normal running after starting, sufficient noise reduction may be achieved by the noise control employing the feedback control system. However, when the noise level itself is high and rapidly increased to a large extent as in the starting of the compressor motor, a processing period from detection of noise by the receiver to completion of the processing causes the timing of producing an artificial sound to slightly lag behind. Although such a timing lag may be ignored in the normal running of the compressor, it increases the difference between the noise and artificial sound. Consequently, sufficient noise reduction cannot be achieved in the starting of the compressor motor.

SUMMARY OF THE INVENTION

Therefore, an object of the present invention is to provide a silencer for deadening noise emanating from the refrigerant compressor during the starting thereof by the effect of sound wave interference.

Another object of the invention is to provide a silencer for deadening noise emanating from the refrigerant compressor after the starting thereof by the effect of sound wave interference.

The silencer of the present invention is employed in a a refrigeration system including an outer cabinet having a compartment, an evaporator for cooling a refrigerant, a compressor for compressing the refrigerant discharged from the evaporator, the compressor being driven by a motor enclosed therein. The silencer comprises the following storage means for previously storing sound wave data for every starting condition of the compressor, the sound wave data corresponding to sound waves produced by the compressor during a starting period thereof, the sound wave data being sound wave signals suitable for reducing sound from the compressor by the effect of sound wave interference, means for determining the starting condition at the starting of the compressor, data reading means for reading out, from the storage means, the sound wave data corresponding to the starting condition determined by the determining means during the starting of the compressor, and a sound producer driven in response to the sound wave data read out from the storage means in the form of an electrical signal, thereby producing sound waves, the sound producer being disposed so that sound is directed to the interior of the compartment.

The invention may also be practiced by the following a silencer comprising a sound receiver receiving sound from the compressor and converting the received sound to a corresponding electrical signal, signal converting means for converting the electrical signal from the sound receiver to a sound wave signal suitable for deadening the sound produced from the compressor by the effect of sound wave interference, a sound producer producing sound in response to the sound wave signal from the signal converting means so that the produced sound is directed to the interior of the compartment, storage means for storing data of sound waves for every different starting condition, the data of sound waves corresponding to sound wave produced during the starting of the compressor and comprising sound wave signals suitable for deadening sound from the compressor by the effect of sound wave interference, determining means for determining the starting condition with the starting of the compressor, means for reading out, from the storage means, the sound wave data corresponding to the starting condition determined by the determining means and supplying the sound wave data read out to the sound producer in the form of an electrical signal, and means for supplying the sound producer with sound wave signals obtained by converting the electrical signals from the sound receiver by the signal converting means after elapse of the starting period of the compressor.

The silencer of the present invention is provided with storage means for previously storing the sound wave data comprising the electrical signals having waveforms suitable for reducing sound by the effect of the sound wave interference. The sound wave data represents the sound waves produced by the compressor during the starting thereof under different starting conditions. Upon starting of the compressor, the sound wave data or sound wave signal corresponding to the starting condition determined by the determining means is read out from the storage means. The sound wave signal is supplied to the sound producer such as a speaker, which is driven. Consequently, the sound produced by the sound producer interferes with the noise produced by the compressor, thereby reducing the noise.

After the starting period, the noise from the compressor is converted to a corresponding electrical signal by the sound receiver such as a microphone. The electrical signal is converted to the sound wave signal having wave forms suitable for deadening the noise by the effect of the sound wave interference. The sound wave signal is supplied to the sound producer such as a speaker, which produces sound interfering with the noise from the compressor.

It is preferable that the compartment may be defined by a ceiling, bottom, side walls and front and rear walls and that one of depth, width and height dimensions of the compartment may be larger than the other two. Consequently, a standing wave of the sound to be deadened is composed in said one direction of the compartment, thereby enhancing the sound deadening by the effect of the sound wave interference.

It may also be preferable that a ventilating opening may be formed in one or more of the walls of the compartment and that the ventilating opening may be formed into a generally rectangular shape extending in the direction perpendicular to the direction that the standing wave is composed in the compartment. Consequently, high frequency components are prevented from leaking out of the compartment.

Other objects of the present invention will become obvious upon an understanding of the illustrative embodiment about to be described or will be indicated in the appended claims, and various advantages not referred to herein will occur to one skilled in the art upon employment of the invention in practice.

DESCRIPTION OF THE PREFERRED EMBODIMENT

An embodiment in which the invention is applied to a household refrigerator will now be described.

Figure 1:
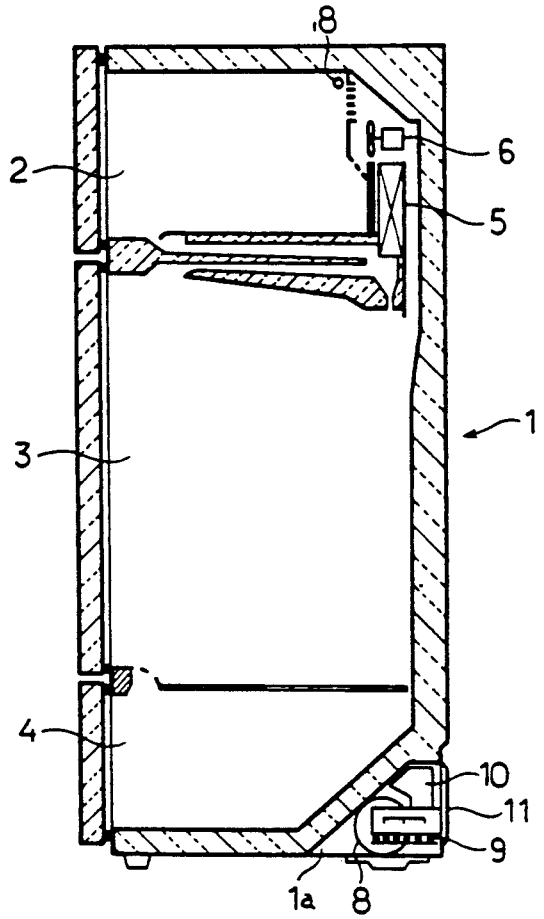
FIG. 1 is a longitudinal sectional view of a refrigerator to which a silencer of an embodiment in accordance with the invention is applied.

Referring first to FIG. 1 illustrating an overall construction of the refrigerator, reference numeral 1 designates a heat-insulative outer cabinet of the refrigerator. The interior of refrigerator cabinet 1 is partitioned to a freezing compartment 2, a storage compartment 3 and a vegetable compartment 4. An evaporator 5 is provided at the backside of freezing compartment 2. A fan 6 is provided for directly supplying chilled air to freezing and storage compartments 2 and 3. A machine compartment 1*a* serving as a compartment is provided at the lower backside of refrigerator cabinet 1. Machine compartment 1*a* is defined by a ceiling, bottom, side walls and front and rear walls. Machine compartment 1*a* encloses a rotary compressor 8 enclosing a motor 7 (not shown - shown-FIG. 4), a condenser pipe 9 and a defrost-water vaporizer 10 employing the so-called ceramic fins. Motor 7 for driving compressor 8 is a well known single-phase induction motor and has a main winding 7*a* and a starting winding 7*b*. Both of the windings 7*a* and 7*b* are energized during the starting of the motor and thereafter, only main winding 7*a* is energized. While compressor 8 is being driven by motor 7, a refrigerant is supplied from compressor 8 to evaporator 5, which cools the refrigerant and fan 6 is driven to perform the heat exchange between evaporator 5 and the refrigerator interior.

Figure 2:
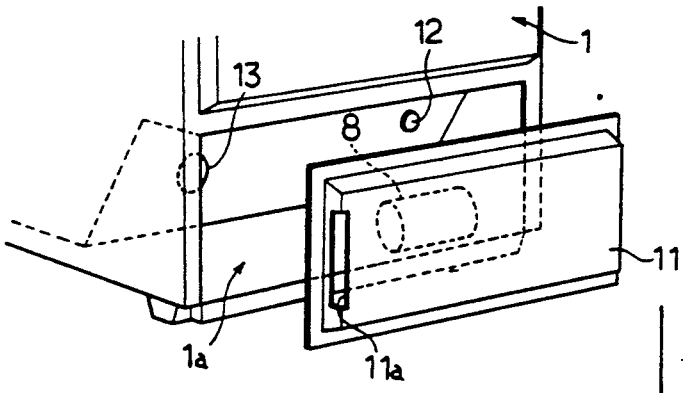
FIG. 2 is an enlarged exploded perspective view of the part of the refrigerator where a compressor is disposed.
Figure 3:
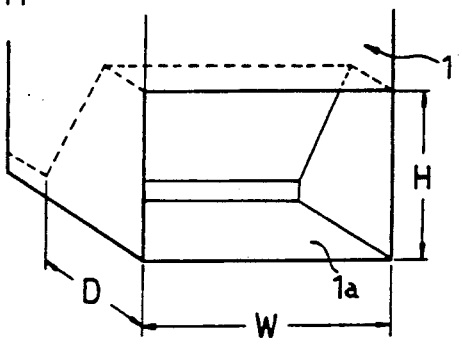
FIG. 3 is a schematic perspective view of the part in FIG. 2 for explanation of the dimensional relationship of the part.

As shown in FIG. 2 wherein condenser pipe 9 and defront-water vaporizer 10 are eliminated, machine compartment 1*a* has at the backside a rectangular opening which is close by a front wall or machine compartment cover 11. In closing the opening of machine compartment 1*a*, the periphery of cover 11 is air-tightly attached against the opening edge of machine compartment 1*a*. A slenderly rectangular ventilating opening 11*a* extending vertically is formed in the left-had edge portion of cover 11, as viewed in FIG. 2. Thus, when cover 11 is attached to machine compartment 1*a*, the same is closed except ventilating opening 11*a*. Cover 11 is formed of a hard material having fine heat-conductivity and large sound-transmission loss property such a metal or steel.

A microphone 12 serving as a noise receiver is provided in machine compartment 1*a*. Microphone 12 is disposed so as to be opposite to compressor 8 from the side opposite to ventilating opening 11*a* (the right-hand side, as viewed in FIG. 2). Microphone 12 generates an electrical signal in accordance with the sound received from compressor 8 as noise source. A speaker 13 serving as sound producing means is provided in machine compartment 1*a*. Speaker 13 is mounted in a portion of an inner wall of machine compartment 1*a* corresponding to the bottom wall of refrigerator cabinet 1, the portion being in the vicinity of ventilating opening 11*a*.

Figure 4:
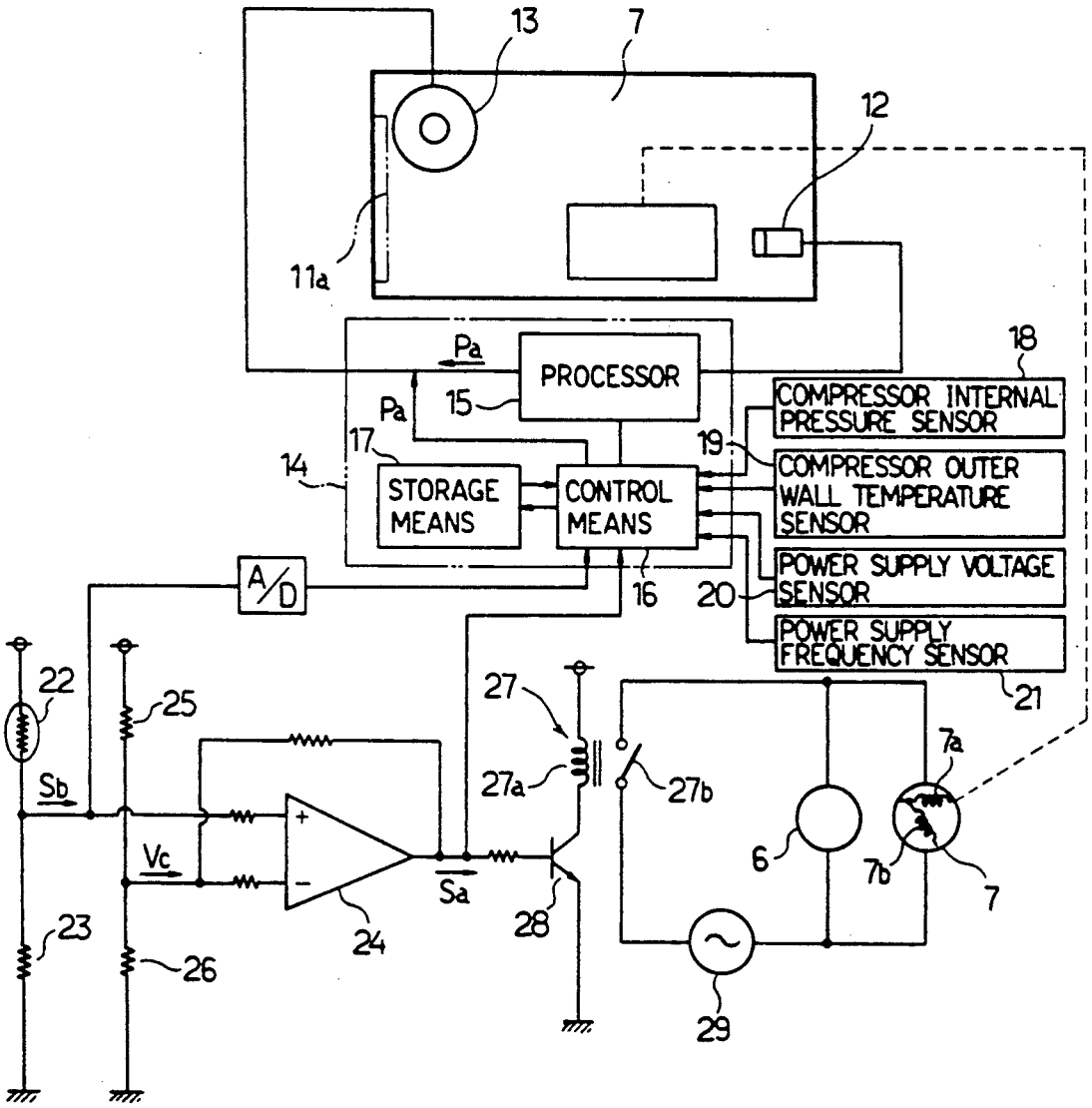
FIG. 4 schematically illustrates an electrical arrangement of the silencer.

Referring to FIG. 4, the electrical signal generated by microphone 12 is processed to a sound wave signal Pa by a processor 15 in an opposite-phase sound generating circuit 14. Sound signal Pa is supplied to speaker 13, which is operated. The above-described electrical signal processing is based on the principle of the sound deadening by the effect of sound wave interference as will be described hereinafter.

Figure 6:
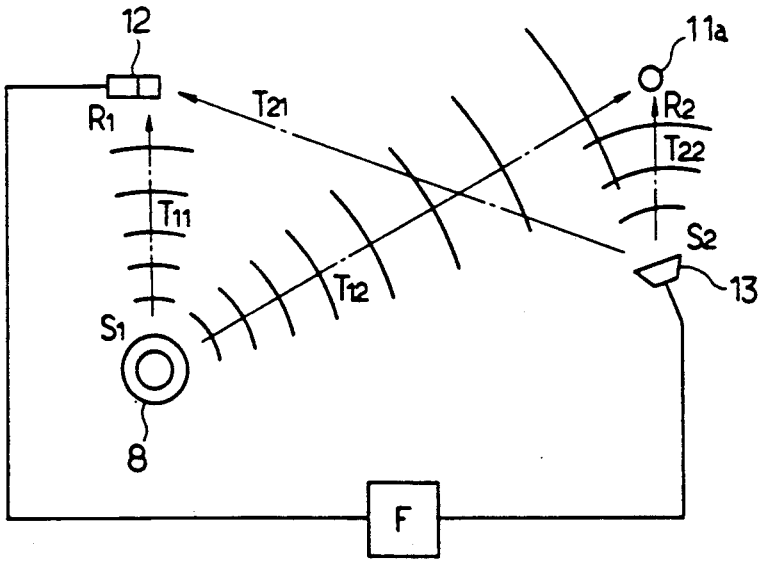
FIG. 6 is a schematic view illustrating the principle of deadening sound by the effect of sound wave interference.

Referring to FIG. 6, the following equation holds as two-input and two-output system:

$$\begin{bmatrix} R1 \\ R2 \end{bmatrix} = \begin{bmatrix} T11 & T21 \\ T12 & T22 \end{bmatrix} \begin{bmatrix} S1 \\ S2 \end{bmatrix}$$

where

S1=sound produced by compressor 8 as noise source

S2=sound produced from speaker 13

R1=sound received by microphone 12

R2=sound at ventilating opening 11*a* as control point

T11, T21, T12, T22=acoustic transfer functions between input and output points of the above sounds respectively Accordingly, sound S2 to be produced by speaker 13 is obtained by the following equation:

$$S2=(-T12 \cdot R1+T11 \cdot R2)/(T11 \cdot T22-T12 \cdot T21)$$

Since the goal is to reduce the acoustic level at ventilating opening 11*a* to zero, zero is substituted for R2 as follows:

$$S2=R1 \cdot T12/(T12 \cdot T21-T11 \cdot T22)$$

As is understood from the equation, in order to render R2 zero, sound R1 received by microphone 12 may be processed by a filter expressed by the following equation:

$$F=T12/(T12 \cdot T21-T11 \cdot T22)$$

Thus, if a processed sound S2 obtained is produced from speaker 15, the sound level at ventilating opening 11*a* can be theoretically rendered zero. Processor 15 is adapted to perform the above-described sound processing at a high speed and supply a sound wave signal Pa to speaker 13.

Figure 7:
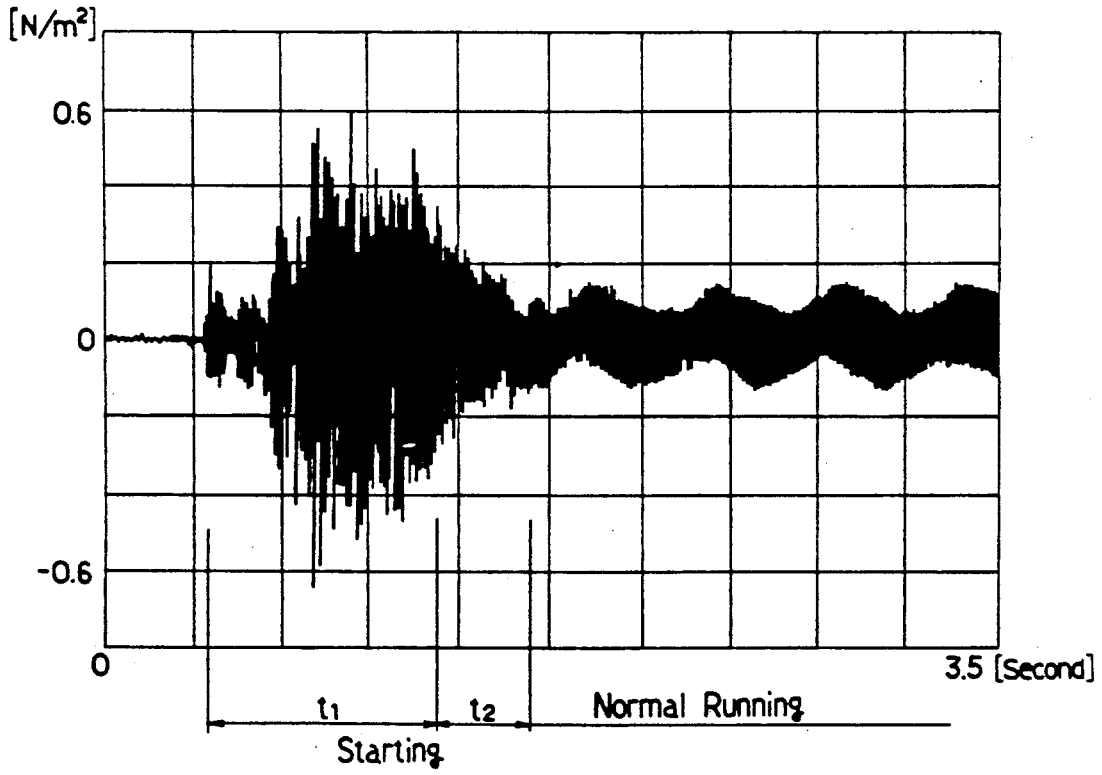
FIG. 7 is a waveform chart of noise produced by the compressor.

Opposite phase sound producing circuit 14 includes control means 16 and storage means 17 as well as processor 15. Storage means 17 stores sound data. The sound produced with starting of compressor 8 is mainly divided into two parts as shown in FIG. 7. Symbol t1 in FIG. 7 represents a period needed to increase the revolution of compressor 8 from 0 to a rated value, 3,600 rpm. and symbol t2 represents a period for which compressor 8 runs at the revolution of approximately 3,600 rpm. with both main and starting windings 7*a* and 7*b* energized. The starting period of compressor 8 refers to the summation of t1 and t2 throughout the description. After the starting, compressor motor is driven with only main winding 7*a* energized in the normal running of compressor 8 and the revolution thereof is maintained at approximately 3,600 rpm. The noise level is lowered in the normal running as compared with the starting. In the period t1, the rate of change in revolution increase of compressor 8 shows different patterns in accordance with the starting condition including factors of compressor internal pressure as a load of compressor 8, compressor outer wall temperature, power supply voltage and frequency. In the period t2, the reached revolution of compressor 8 takes different values depending on the starting condition including factors of the power supply voltage and frequency and the storage compartment temperature. Accordingly, a pattern of noise from compressor 8 or the wave forms of sound wherein the frequency component is regarded as a part of wave component depend on the starting conditions. Storage means 17 stores data of sound wave forms corresponding to the different starting conditions in the periods t1 and t2 with respect to the sound produced by compressor 8. When the sound wave form data is read out as sound wave signal Pa, the sound wave signal Pa is processed so as to be suitable for reducing noise from compressor 8 by the effect of sound wave interference.

Control means 16, serves as means for determining the starting condition prior to starting of compressor 8. Control means 16 is supplied with various signals from a pressure sensor 18 for sensing the internal pressure of compartment 8, temperature sensor 19 for sensing the temperature of the outer wall of the compressor casing, a power supply voltage sensor 20 for sensing the power supply voltage, a power supply frequency sensor 21 for sensing the power supply frequency, and a storage compartment temperature sensor 22 for sensing the temperature of the storage compartment interior. Secondly, control means 16 is adapted to receive a drive signal Sa for driving compressor 8. At the starting of compressor 8, control means 16 fetches, from storage means 17, data of sound wave signal Pa corresponding to the starting condition determined prior to the starting. The fetched data is supplied to speaker 13, if necessary, through a filter provided in control means 16. After starting of compressor 8, the electrical signal from microphone 12 is processed to a sound wave signal Pa by processor 15 in the feedback control mode and the processed signal is supplied to speaker 13 which is driven.

An electrical circuit originally provided in the refrigerator is utilized as that for producing the drive signal Sa and compressor 8 and fan 6 are driven during output of the drive signal Sa. Circuit arrangements for these purposes will be briefly descried with reference to FIG. 4. Sensor or thermistor 22 is connected in series to a resistance 23 for the purpose of sensing the temperature of freezing compartment 2. A temperature signal Sb indicative of the temperature of freezing compartment 2 is generated by sensor 22. A comparator 24 compares temperature signal Sb with a reference voltage Vc produced from the common connection between resistances 25 and 26. When the level of temperature signal Sb is above the reference voltage Vc, comparator 24 generates a high level drive signal Sa. As described above, when the temperature of freezing compartment 2 is increased to a predetermined value, high level drive signal Sa is generated by comparator 24 as the level of temperature signal Sb is above the reference voltage Vc. High level drive signal Sa is supplied to the base of transistor 28 for driving relay 27. Relay coil 27*a* of relay 27 is arranged so as to be excited when transistor 28 is turned on. Normally open switch 27*b* of relay 27 is closed when relay coil 27*a* is excited, thereby driving compressor 8 (not shown in FIG. 4) and fan 6 to which commercial AC power supply 29 is connected.

In the refrigerator constructed as described above, the level of noise produces with drive of compressor 8 in machine compartment 1*a* has a characteristic that the level is increased in the range below 700 Hz and in the ranges between 1.5 and 5 kHz. Of the noise of the respective ranges, the high frequency noise can be damped by way of transfer loss through machine compartment cover 11 or the like and dissipated by providing a sound absorption member in machine compartment 1*a*. Accordingly, the active noise control by he above-described microphone 12, speaker 13 and processor 4 is aimed at the noise in the range below 700 Hz as a target frequency.

In the above-described noise control by way of the sound wave interference, it is important that the noise in machine compartment 1*a* be composed to be a one-dimensional plane traveling wave so that the noise control is performed theoretically and technically with each and accuracy. In the embodiment, for example, the width W or transverse dimension of machine compartment 1*a* is determined so as to take a value larger than those of the depth D or front-to-back dimension and height H or longitudinal dimension thereof. More definitely, the width W is determined to be 600 mm and each of the depth D and height H 200 mm. In other words, the dimension of width W is approximated to the wavelength of the sound to be deadened and the dimensions of depth and height are shorter than the wavelength of the sound to be deadened such that a standing wave of the sound in machine compartment 1*a* holds only for a primary mode. When machine compartment 1*a* is considered a rectangular cavity, the following equation holds:

$$f = C \cdot \sqrt{(Nx/Lx)^2 + (Ny/Ly)^2 + (Nz/Lz)^2} \;/2$$

wherein f=resonant frequency (Hz)

Nx, Ny and Nz=ordinal modes in th directions of X, Y and Z, respectively

Lx, Ly and Lz=dimension in the directions of X, Y and Y in machine compartment 1*a*, that is, D, W and H, respectively C=sound velocity From the above equation, frequencies fx, fy and fz of a first standing wave in the respective directions of X, Y and Z can be obtained.

More specifically, when the depth D is determined to be 200 mm with the width W and height H 600 mm and 200 mm, respectively, the frequency fx of the first standing wave of a fundamental wave in the direction of X can be obtained as:

$$fx = 340\sqrt{(1/0.2)^2}\;/2$$
$$= 850 \text{ Hz}$$

wherein

Ny=Nz=0

C=340 m/sec.

Similarly, frequencies fy and fz of the first standing wave of the fundamental wave in the respective directions of Y and Z can be obtained as:

$$fy = 340\sqrt{(1/0.6)^2}\;/2$$
$$= 283 \text{ Hz}$$

$$fz = 340\sqrt{(1/0.2)^2}\;/2$$
$$= 850 \text{ Hz}$$

Consequently, in the range below the target frequency (700 Hz), the standing wave of sound in machine compartment 1*a* holds in the mode of the direction of Y (direction of the width) and, therefore, the sound produced in machine compartment 1*a* may be considered a one-dimensional plane traveling wave. Consequently, the theoretical handling of the wave front can be rendered easy when sound is to be deadened by way of the sound wave interference in the use of speaker 13 and the like, and the silencing control can be performed with ease and accuracy.

Since the ventilating opening 11*a* is formed into a generally slenderly rectangular shape extending in the direction perpendicular to the direction in which the standing wave travels (direction of the width W of machine compartment 1*a*), it is difficult for the harmonic component of the one-dimensional plane traveling wave to leak out of machine compartment 1*a* through ventilating opening 11*a*, whereby the noise control may be ensured. Since machine compartment 1*a* communicates to the outside through ventilating opening 11*a*, the machine compartment interior temperature is not excessively increased due to heat generated during drive of compressor 8.

Figure 5:
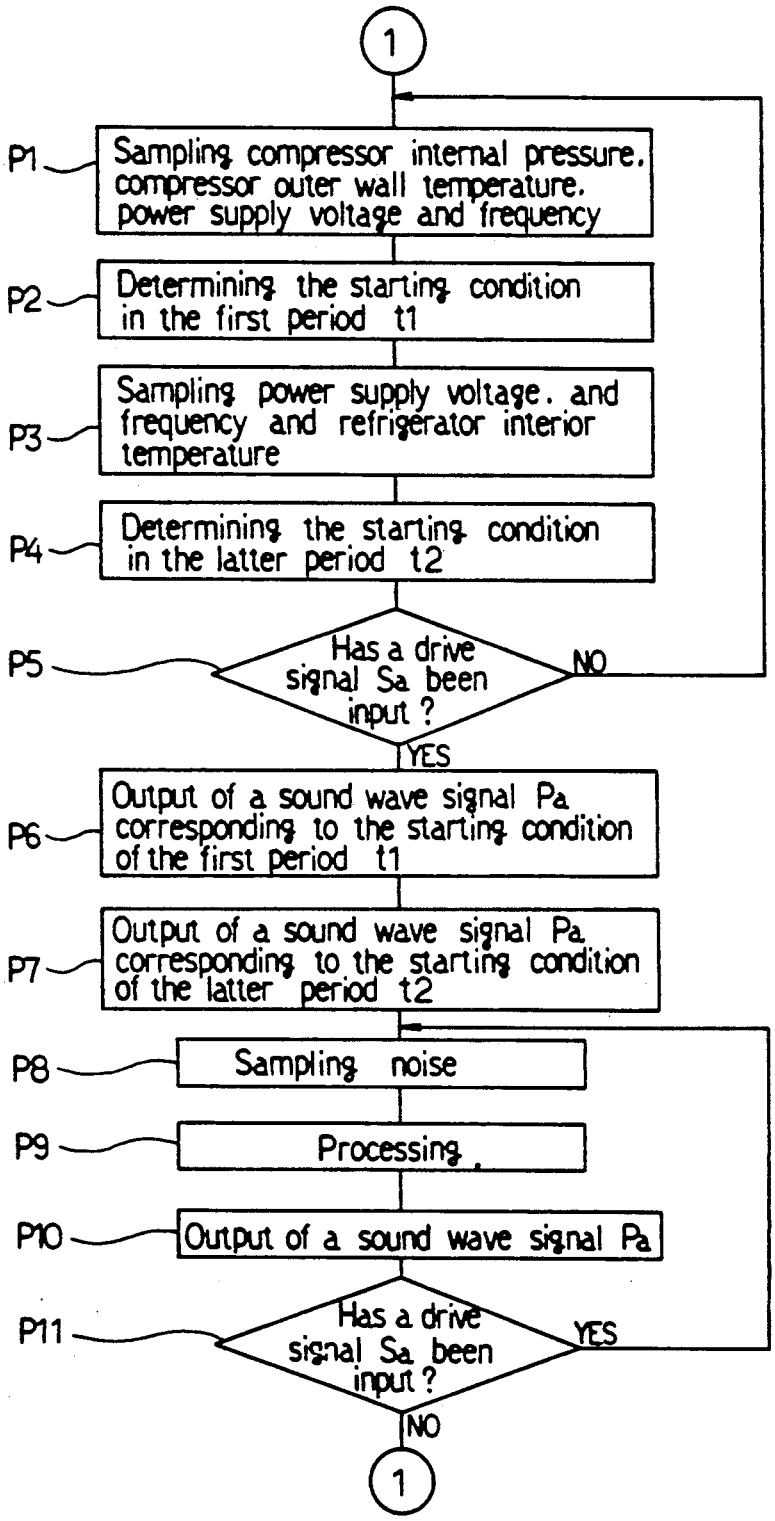
FIG. 5 is a flowchart for explaining the operation of the silencer.

Functions of opposite-phase sound producing circuit 14 comprising processor 15 and control means 16 will now be described with reference to FIG. 5. While compressor 8 is turned off with the freezing compartment interior temperature below the predetermined value, the routine from step P1 to step P5 is reiteratively executed. More specifically, based on the outputs from compressor internal pressure sensor 18, outer wall temperature sensor 19, power supply voltage sensor 20 and power supply frequency sensor 21, the internal pressure of compressor 8, outer wall temperature, power supply voltage and frequency are sampled at step P1. The compressor starting condition in the first period t1 is determined based on the result of the sampling at step P2. Then, based on the outputs from power supply voltage sensor 20, power supply frequency sensor 21, refrigerator interior temperature sensor 22, the power supply voltage and frequency and refrigerator interior temperature are sampled at step P3. The compressor starting condition in the latter period t2 is determined based on the result of the sampling at step P4. The above-described routine is reiteratively executed while compressor 8 is turned off, at step P5.

Thereafter, with increase of the freezing compartment temperature, the level of temperature signal Sb from refrigerator interior temperature sensor 22 is increased. When the temperature signal level exceeds the reference voltage Vc, the drive signal Sa is generated by comparator 24, thereby starting compressor 8. Simultaneously, the drive signal Sa is supplied to control means 16. Opposite-phase sound generating circuit 14 advances from step P5 to step P6 on condition that the drive signal Sa has been supplied to control means 16. The noise control during the compressor starting period is executed at steps P6 and P7. More specifically, in the first starting period t1, control means 16 fetches from storage means 17 sound wave data corresponding to the starting condition of the first starting period t1 determined prior to starting of compressor 8. The fetched sound wave data is processed to a sound wave signal Pa, which is supplied to speaker 13 at step P6, thereby activating the speaker. In the latter starting period t2, control means 16 fetches from storage means 17 sound wave data corresponding to the starting condition of the latter starting period t2 determined prior to starting of compressor 8. The fetched sound wave data is processed to a sound wave signal Pa, which is supplied to speaker 13 at step P7, thereby activating the speaker.

As described above, the compressor starting conditions are previously determined prior to starting of the compressor. Speaker 12 is supplied with sound wave signals Pa corresponding to the determined starting conditions. As a result, an artificial sound in accordance with the starting conditions is timely produced by speaker 12 such that the artificial sound has an opposite phase to the noise and the same frequency and amplitude as the noise with approximate certainty at the objective control point (ventilating opening 11*a*), thereby effectively deadening the noise.

On the other hand, after starting of compressor 8 or elapse of the periods t1 and t2, the feedback noise control is executed for the normal running of compressor 8. More specifically, the noise sampled by microphone 12 is converted to an acoustic signal at step P8. The acoustic signal is processed by processor 15 based on the acoustic transfer functions into a sound wave signal Pa at step P9. The sound wave signal Pa is supplied to speaker 13 at step P10, thereby driving the speaker to produce an artificial sound. The artificial sound is caused to interfere with the noise such that the noise is reduced. Such feedback noise control as described above (steps P8 to P11) is reiteratively performed during the running of compressor 8 or while drive signal Sa is input to the base of drive transistor 28 of relay 27. Subsequently, when the freezing compartment temperature is decreased below the predetermined value, input of the drive signal Sa is interrupted and compressor 8 is deenergized. When compressor 8 is deenergized, it is determined at step P11 that the drive signal Sa has not been input. Then, execution of the feedback noise control is stopped. Thereafter, the compressor starting conditions are reiteratively determined during deenergization of compressor 8.

As obvious from the foregoing embodiment, the compressor starting conditions are previously determined from the viewpoint that the noise pattern in starting the compressor depends upon the compressor starting conditions. The sound wave data in accordance with the starting conditions is stored in storage means 17 in the form suitable for the noise deadening by the effect of the sound wave interference. The suitable sound wave data is fetched from storage means 17 with the starting of compressor 8 and speaker 13 is operated based on the fetched sound wave data. Consequently, artificial sound in accordance with the starting condition is timely produced by speaker 13 such that the artificial sound has an opposite phase to the noise and the same frequency and amplitude as the noise with approximate certainty at the objective control point (ventilating opening 11*a*), thereby effectively deadening the noise. The feedback noise control is then executed after starting of compressor 8. In the feedback noise control, the artificial sound produced by speaker 13 is controlled in accordance with characteristics of the noise, thereby actively deadening the noise.

Although the sound wave signal Pa obtained by processing the sound produced with starting of the compressor is stored in storage means 17 as data in the foregoing embodiment, the sound produced with starting of the compressor (acoustic signal) may be stored in storage means 17 instead.

Although data stored in storage means 17 is effectuated in the form of the sound wave signal Pa when fetched therefrom, in the foregoing embodiment, the data fetched from storage means 17 may be processed by the processor to thereby obtain the sound wave signal. In this respect, a processing period needs to be taken into account.

Since the compressor starting period is divided into the first starting period t1 and the latter starting period t2 in the foregoing embodiment, it is advantageous on the point that the noise control accuracy may be improved. Instead, a sound wave signal for use throughout the starting period may be fetched from storage means 17 based on a single determined starting condition, without dividing the starting period into two parts t1 and t2.

Although a plurality of determination factors are relied upon when the compressor starting condition is determined, in the foregoing embodiment, the degree of load against compressor 8 may be employed as at least only one such determination factor. Furthermore, determination factors other than those described above may be employed.

Although the invention has been applied to the household refrigerator in the embodiment, it may be applied to other refrigeration systems such as an outdoor unit of a room air conditioner or a refrigerative display case.

The foregoing disclosure and drawings are merely illustrative of the principles of the present invention and are not to be interpreted in a limiting sense. The only limitation is to be determined from the scope of the appended claims.

What we claim is:

1. A silencer for refrigeration system including an outer cabinet having a compartment, an evaporator for cooling a refrigerant, and a compressor for compressing the refrigerant discharged from the evaporator, the compressor being driven by a motor enclosed therein, the silencer preventing sound produced by the compressor from emanating from the compartment, comprising:

a) storage means for previously storing sound wave data for every different starting condition of the compressor, the sound wave data corresponding to sound waves produced by the compressor during a starting period thereof, the sound wave data being sound wave signals suitable for reducing sound from the compressor by the effect of sound wave interference;

b) means for determining the starting condition prior to the starting of the compressor;

c) data reading means for reading out, from the storage means, the sound wave data corresponding to the starting condition determined by the determining means, during the starting of the compressor; and d) a sound producer driven in response to the sound wave data read out from the storage means in the form of an electrical signal, thereby producing sound waves, the sound producer being disposed so that sound is directed to the interior of the compartment.

2. A silencer according to claim 1, wherein the determining means comprises sensors for the compressor internal pressure, the compressor outer wall temperature, the power supply voltage and frequency, respectively and the determining means determining the starting condition based on the compressor internal pressure, the compressor outer wall temperature, the power supply voltage and frequency sensed by the respective sensors.

3. A silencer according to claim 1, wherein the compressor motor includes a single-phase induction motor having a main winding and a starting winding both of which are simultaneously energized during the compressor starting period.

4. A silencer according to claim 3, wherein the sound wave data stored in the storage means includes a first group of data corresponding to a rise period of the compressor rotation with both motor windings energized and a second group of data corresponding to a rated speed rotation with both motor windings energized.

5. A silencer according to claim 4, wherein the data reading means reads out the sound wave data from the first group of sound wave data in the first half of the compressor starting period and from the second group of sound wave data in the latter half of the compressor starting period.

6. A silencer for refrigeration system including an outer cabinet having a compartment, an evaporator for cooling a refrigerant, and a compressor for compressing the refrigerant discharged from the evaporator, the compressor being driven by a motor enclosed therein, the silencer preventing sound produced by the compressor from emanating from the compartment, comprising:

a) a sound receiver receiving sound from the compressor and converting the received sound to a corresponding electrical signal;

b) signal converting means for converting the electrical signal from the sound receiver to a sound wave signal suitable for deadening the sound produced from the compressor by the effect of sound wave interference;

c) a sound producer producing sound in response to the sound wave signal from the signal converting means so that the produced sound is directed to the interior of the compartment;

d) storage means for storing data of sound waves for every different starting condition, the data of sound waves corresponding to sound wave produced during the starting of the compressor and comprising sound wave signals suitable for deadening sound from the compressor by the effect of sound wave interference;

e) determining means for determining the starting condition prior to the starting of the compressor;

f) means for reading out, from the storage means, the sound wave data corresponding to the starting condition determined by the determining means and supplying the sound wave data read out to the sound producer in the form of an electrical signal; and g) means for supplying the sound producer with sound wave signals obtained by converting the electrical signals from the sound receiver by the signal converting means, during the starting period of the compressor.

7. A silencer according to claim 6, wherein the compressor compartment is defined by ceiling, bottom, side, front and rear walls and one of dimensions of the depth, width and height of the compressor compartment has a value larger than the other two such that a standing wave of sound to be deadened is composed only in the direction of said one dimension having the value larger than the other two.

* * * * *